US009737183B2

(12) United States Patent
Grey

(10) Patent No.: US 9,737,183 B2
(45) Date of Patent: Aug. 22, 2017

(54) VACUUM CLEANER

(71) Applicant: GREY TECHNOLOGY LIMITED, a British Corporation, Worcester (GB)

(72) Inventor: Nicholas Gerald Grey, Spetchley (GB)

(73) Assignee: GREY TECHNOLOGY LIMITED (GB)

( * ) Notice: Subject to any disclaimer, the term of this patent is extended or adjusted under 35 U.S.C. 154(b) by 656 days.

(21) Appl. No.: 14/245,796

(22) Filed: Apr. 4, 2014

(65) Prior Publication Data

US 2014/0304938 A1 Oct. 16, 2014

(30) Foreign Application Priority Data

Apr. 10, 2013 (GB) ..... 1306512.3

(51) Int. Cl.
*A47L 5/30* (2006.01)
*A47L 9/24* (2006.01)
(Continued)

(52) U.S. Cl.
CPC *A47L 5/30* (2013.01); *A47L 5/32* (2013.01); *A47L 9/242* (2013.01); *A47L 9/244* (2013.01); *A47L 9/2857* (2013.01); *A47L 9/2863* (2013.01)

(58) Field of Classification Search
CPC ... A47L 5/50; A47L 5/32; A47L 9/242; A47L 9/2857; A47L 9/244; A47L 9/2863; A47L 5/30
(Continued)

(56) References Cited

U.S. PATENT DOCUMENTS 1,829,582 A 10/1931 Carson
2,375,331 A 5/1945 Taylor
(Continued)

FOREIGN PATENT DOCUMENTS

DE 3016965 A1 11/1981
DE 102004041021 B3 8/2005
(Continued)

OTHER PUBLICATIONS

PCT Written Opinion of the International Searching Authority, PCT/GB2014/051737, date of mailing: Aug. 22, 2014, Applicant: Grey Technology Limited.
(Continued)

*Primary Examiner* — David Redding
(74) *Attorney, Agent, or Firm* — Pedersen and Company, PLLC; Ken J. Pedersen; Barbara S. Pedersen

(57) ABSTRACT

A vacuum cleaner is described, and in particular a battery-powered vacuum cleaner including a rotatable brush. The vacuum cleaner has a suction head adapted to be moved across a surface to be cleaned, the suction head having a leading end and a trailing end, the suction head having: a rotatable brush, the rotatable brush being located in a brush chamber at the leading end of the suction head, the brush chamber having an opening through which a part of the rotatable brush projects, the opening and the rotatable brush spanning substantially the full width of the suction head; suction means adapted to create a flow of air into the suction head during use; a dirt-collection chamber; a filter located downstream of the dirt-collection chamber; a primary air flow duct connecting the brush chamber to the dirt-collection chamber and through which air can flow into the dirt collection chamber during use, a secondary air flow duct connected to the dirt-collection chamber and through which air can flow into the dirt collection chamber during use, the
(Continued)

Figure 1:
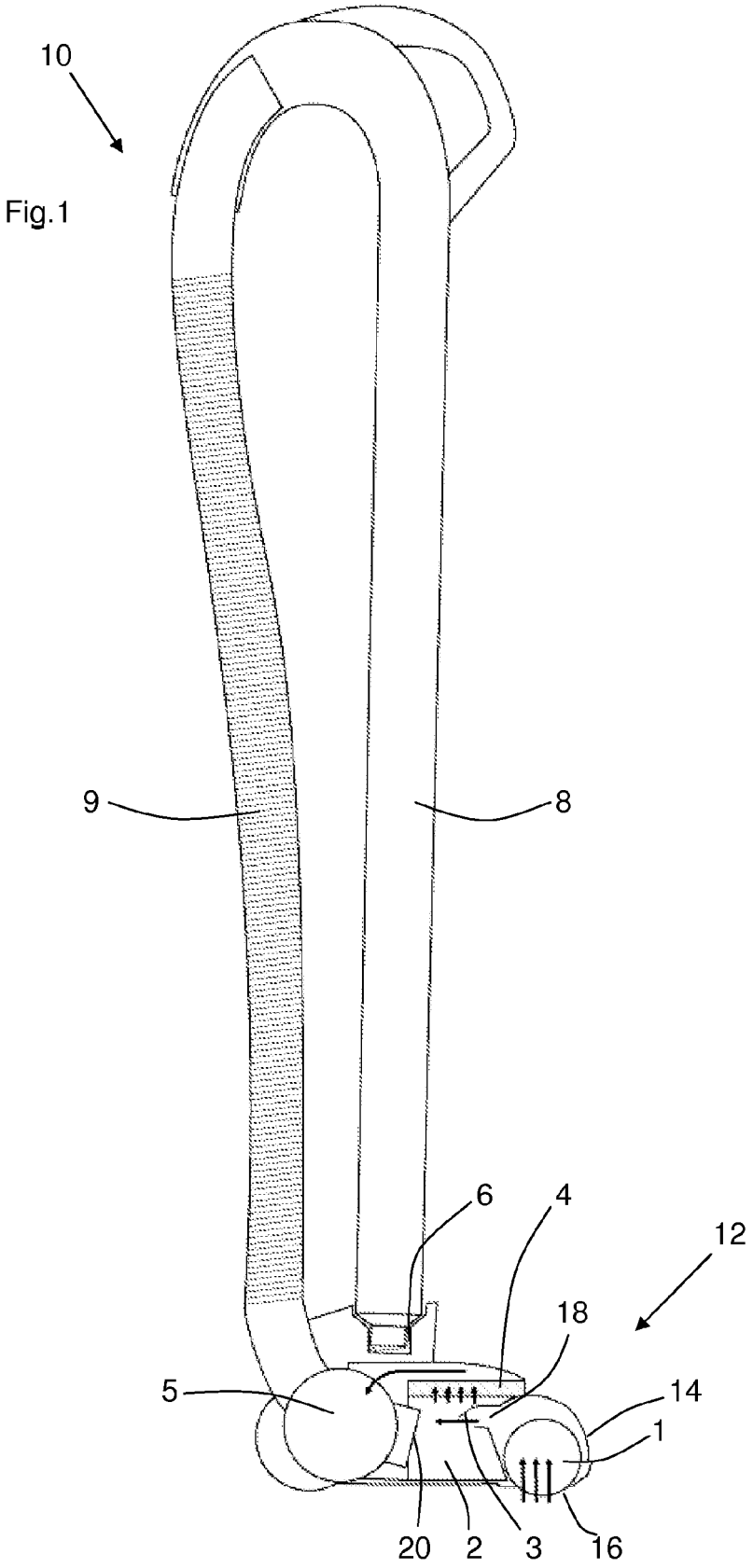

secondary air flow duct comprising a length of hose terminating in an inlet nozzle.

13 Claims, 2 Drawing Sheets

(51) Int. Cl.
*A47L 9/28* (2006.01)
*A47L 5/32* (2006.01)

(58) Field of Classification Search
USPC ..... 15/338
See application file for complete search history.

(56) References Cited

U.S. PATENT DOCUMENTS

| | | | | |
|---|---|---|---|---|
| 2,867,833 | A | 1/1959 | Duff | |
| 4,905,342 | A | 3/1990 | Ataka | |
| 4,924,548 | A | 5/1990 | Touya et al. | |
| 5,590,439 | A | 1/1997 | Alazet | |
| 6,009,594 | A | 1/2000 | Grey | |
| 6,055,701 | A | 5/2000 | Grey et al. | |
| 6,101,668 | A | 8/2000 | Grey | |
| 6,243,912 | B1 | 6/2001 | Grey | |
| 6,949,130 | B1 | 9/2005 | Grey et al. | |
| 6,968,587 | B2 | 11/2005 | Grey | |
| 7,013,521 | B2 | 3/2006 | Grey | |
| 7,017,221 | B1 | 3/2006 | Grey et al. | |
| D554,814 | S | 11/2007 | Grey | |
| 7,331,078 | B2 | 2/2008 | Grey | |
| 7,334,284 | B2 | 2/2008 | Grey | |
| D568,008 | S | 4/2008 | Grey | |
| 7,694,383 | B2 * | 4/2010 | Zahuranec | A47L 5/30 15/329 |
| 7,802,343 | B2 | 9/2010 | Grey | |
| D694,481 | S | 11/2013 | Grey et al. | |
| 2002/0148070 | A1 | 10/2002 | Tsuchiya et al. | |
| 2004/0074027 | A1 | 4/2004 | Grey | |
| 2005/0138764 | A1 | 6/2005 | Grey | |
| 2006/0000040 | A1 | 1/2006 | Grey et al. | |
| 2007/0022563 | A1 | 2/2007 | Wu | |
| 2008/0022485 | A1 | 1/2008 | Grey | |
| 2008/0235897 | A1 | 10/2008 | Kim et al. | |
| 2009/0300873 | A1 | 12/2009 | Grey | |
| 2013/0291333 | A1 | 11/2013 | Grey | |

FOREIGN PATENT DOCUMENTS

| | | | |
|---|---|---|---|
| DE | 202011051194 | U1 | 2/2013 |
| EP | 0232761 | A2 | 8/1987 |
| EP | 0847721 | A2 | 6/1998 |
| EP | 2215947 | A2 | 8/2010 |
| GB | 1276402 | A | 6/1972 |
| GB | 2269475 | A | 2/1994 |
| JP | S55124237 | U | 9/1980 |
| JP | S5644642 | U | 4/1981 |
| JP | H03237949 | A | 10/1991 |
| JP | 2004337427 | A | 12/2004 |
| JP | 2006312066 | A | 11/2006 |
| WO | 0150935 | A1 | 7/2001 |
| WO | 2006/131706 | A1 | 12/2006 |
| WO | 2014/195711 | A1 | 12/2014 |

OTHER PUBLICATIONS

PCT International Search Report, PCT/GB2014/051737, date of mailing: Aug. 22, 2014, Applicant: Grey Technology Limited.
GB Examination Report, Application No. GB1420520.7, date of report: Jan. 27, 2015, Applicant: Grey Technology Limited, Intellectual Property Office, UK.
GB Examination Report, Application No. GB1420520.7, date of report: Jun. 3 2015, Applicant: Grey Technology Limited, Intellectual Property Office, UK.
List of Examiner citations, Search Report, in corresponding Application No. GB1406139.4, Grey Technology, date of search: Oct. 6, 2014.
PCT International Search Report for PCT/GB2011/052542, mailed Mar. 29, 2012, Applicant: Grey.
Search Report for GB1021655.4, reported Apr. 21, 2011, Applicant: Grey, Intellectual Property Office, UK.
Translation of German Patent DE 10 2004 041 021 B3.

* cited by examiner

VACUUM CLEANER

This application claims priority of UK Patent Application 1306512.3 filed on Apr. 10, 2013.

FIELD OF THE INVENTION

This invention relates to a vacuum cleaner, and in particular a battery-powered vacuum cleaner including a rotatable brush.

Figure 2:
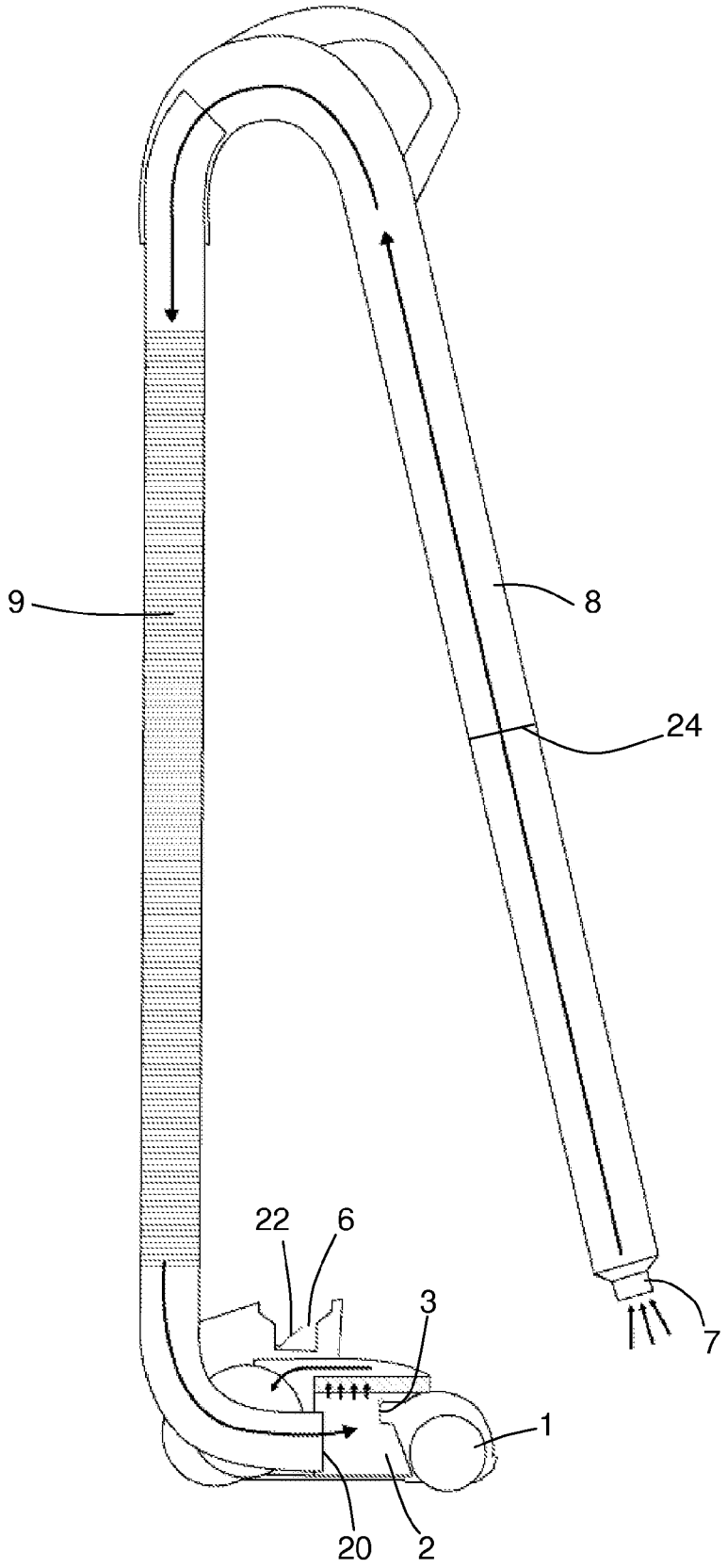

In the following description, directional and orientational terms such as "top", "bottom" etc. refer to the vacuum cleaner in its normal orientation of use upon a substantially horizontal surface, as represented in FIGS. 1 and 2. It will be understood, however, that the vacuum cleaner can be used in other orientations.

BACKGROUND TO THE INVENTION

Vacuum cleaners have a motor which typically drives an impeller to create a flow of air. The suction head of the vacuum cleaner has an opening in its bottom wall through which air can enter, the air carrying dirt and debris into the suction head. It is arranged that the air transports the dirt and debris by way of air flow ducts within the suction head, the ducts typically having a cross-sectional area measuring around 7 to 10 $cm^2$. The dirt and debris is transported through the ducts to a dirt-collection chamber. The air then passes through one or more filters before leaving the vacuum cleaner, the filters being arranged to trap the dirt and debris within the dirt-collection chamber for subsequent disposal.

The dirt-collection chamber can contain or comprise a disposable bag, the wall of the bag also acting as a filter. Alternatively, the dirt-collection chamber is a receptacle which can be removed from the vacuum cleaner, emptied, and re-installed into the vacuum cleaner for re-use.

Many vacuum cleaners have a rotatable brush located adjacent to the opening of the suction head. The brush is rotated and engages the surface which is being cleaned. The brush helps to dislodge dirt and debris from the surface which is then gathered into the air flow and transported to the dirt-collection chamber.

Many vacuum cleaners are mains powered, and the manufacturers of mains powered vacuum cleaners will often seek to maximise the electrical and suction power of their vacuum cleaners in an attempt to increase their marketability. Typically, the opening of the suction head is surrounded by a wall which permits a relatively small air flow into the travelling head. The air is forced to pass underneath the wall, through the underlying carpet or other floor covering, whereby to dislodge dirt and debris from between the fibres of the carpet. As impellers are typically 10 to 40% efficient in use and air is not particularly good at dislodging dust, dirt and debris, this is a relatively inefficient method of cleaning. In order to achieve higher impeller efficiencies, manufacturers have tended to develop faster spinning impellers creating higher suction. However, as it is air flow rather than suction which dislodges dirt and debris, such vacuum cleaners generally do not achieve improved dirt and debris collection efficiency. Manufacturers have therefore tended to quote electrical and suction power as an indicator of the effectiveness of their appliances rather than cleaning efficiency.

It is also known to provide battery-powered vacuum cleaners. Battery-powered vacuum cleaners employing this traditional approach cannot provide the suction power of a mains powered vacuum cleaner without prejudicing the operating cycle of the vacuum cleaner, i.e. without unacceptably shortening the period between battery recharging, and therefore do not provide comparable cleaning performance.

Most domestic vacuum cleaners fall into two broad classes. The first class is often referred to as cylinder vacuum cleaners. In cylinder vacuum cleaners the suction head is connected to an operating handle which in turn is connected to a flexible hose through which the dirt and debris pass on their way to the dirt-collection chamber. The dirt-collection chamber is located within a body which is separate from the suction head and which also contains the motor, the body having wheels or slides by which it may be pulled across the floor during the cleaning operation.

The second class is often referred to as upright vacuum cleaners. In upright vacuum cleaners the motor and dirt-collection chamber are carried by, or in some cases are integral with, the operating handle, so that the body containing the motor and the dirt-collection chamber typically lie above the suction head during the cleaning operation.

The suction head of both classes of vacuum cleaner can be fitted with a rotating brush. Also, both classes of vacuum cleaner can incorporate a steering joint between the suction head and the operating handle, allowing the suction head to be steered in a chosen direction.

Because the suction head of a cylinder vacuum cleaner is connected to the body by way of a flexible hose, the suction head can be manoeuvred for "above-floor cleaning", i.e. the cleaning of walls, stairs and the like. Also, the suction head can typically be removed from the hose and replaced by a dust brush, crevice tool, or other cleaning tool whereby to undertake a particular cleaning operation.

It is not possible to manoeuvre the suction head of an upright vacuum cleaner in the same way as that of a cylinder vacuum cleaner, and in order to enable above-floor cleaning the manufacturers of upright vacuum cleaners often provide an alternative solution. Specifically, the upright vacuum cleaner is typically fitted with a length of extendable flexible hose between the suction head and the dirt-collection chamber, the end of the hose adjacent to the suction head being releasable whereby the end of the released hose can be fitted with a cleaning tool and manoeuvred to the desired location without the user having to move the suction head. The flexible hose is typically made extendable so that during normal use of the vacuum cleaner the contracted hose can fit easily and conveniently upon the body of the vacuum cleaner. When released the hose can be extended to reach the desired location.

Once again, however, the hose is difficult to manoeuvre to the location of use, and the resilience of the hose increases the force which must be provided in order to reach less accessible locations. The force required often exceeds that required to tip over the vacuum cleaner, and it is known for an upright vacuum cleaner to fall over during periods of use of the extended hose.

The vacuum cleaner described in our patent application WO2012/085567 avoids or reduces many of the problems associated with battery powered vacuum cleaners, and can achieve cleaning performance similar to that of a mains powered vacuum cleaner.

SUMMARY OF THE INVENTION

The present invention seeks to improve upon the vacuum cleaner described in WO2012/085567, and is specifically directed to a battery powered vacuum cleaner which can be used for above-floor cleaning.

According to the present invention there is provided a vacuum cleaner having a suction head adapted to be moved across a surface to be cleaned, the suction head having a leading end and a trailing end, the suction head having:

a rotatable brush, the rotatable brush being located in a brush chamber at the leading end of the suction head, the brush chamber having an opening through which a part of the rotatable brush projects, the opening and the rotatable brush spanning substantially the full width of the suction head;

an impeller;

a motor for driving the impeller;

a dirt-collection chamber spanning substantially the full width of the suction head;

a filter means located between the dirt-collection chamber and the impeller;

a primary air flow duct connecting the brush chamber to the dirt-collection chamber, characterised by a secondary air flow duct connected to the dirt-collection chamber, the secondary air flow duct comprising a length of hose terminating in an inlet nozzle.

Preferably, the suction head has a receptacle for the inlet nozzle, the inlet nozzle being received in the receptacle when not in use. Preferably the inlet nozzle is a substantially air-tight fit within the receptacle whereby little or no air can enter the inlet nozzle when it is located within the receptacle.

It will be understood that during use of the vacuum cleaner air (and entrained dirt and debris) is drawn into the dirt-collection chamber through one or other of the primary air duct and the secondary air duct. The substantially air-tight fit of the inlet nozzle into the receptacle ensures that, when the secondary air duct is not in use, substantially all of the air flow enters the dirt-collection chamber by way of the primary air duct, i.e. through the opening adjacent to the rotating brush.

Desirably, the primary air flow duct includes a valve member which can substantially close the primary air duct. This permits the primary air duct to be closed when the secondary air duct is in use, so that substantially all of the air flow passes along the secondary air duct.

Preferably, the receptacle has a switch which can be actuated by the inlet nozzle. Preferably also, the switch controls the position of the valve member. It can therefore be arranged that the removal of the inlet nozzle from the receptacle triggers the valve member to close the primary air flow duct (and thereby substantially prevent the flow of air along the primary air flow duct), and that insertion of the inlet nozzle into the receptacle actuates the switch and triggers or allows the valve member to open (allowing air flow along the primary air flow duct).

It will therefore be understood that when the vacuum cleaner is to be used for floor cleaning, the inlet nozzle is "parked" in its receptacle and air is drawn through the primary air duct. When the vacuum cleaner is to be used for above-floor cleaning, or for cleaning particular areas by way of a crevice tool or the like, the inlet nozzle is removed from its receptacle and air is drawn through the inlet nozzle and along the secondary air duct.

Air therefore flows along the secondary air duct only when it is required to do so for above-floor cleaning and the cleaning of particular areas. During floor cleaning when the air flows along the primary air flow duct the air flow path to the dirt-collection chamber is short and the pumping losses are minimised. This is different to most upright vacuum cleaners in which the extendable flexible hose provides the duct between the suction head and the dirt-collection chamber.

Preferably, the hose comprises a flexible hose connected to a substantially rigid hose. The flexible hose may be extendable. Thus, whilst it is desirable to provide a flexible hose to permit the manipulation of the inlet nozzle (and any tool fitted thereto), the available manipulation can be increased by allowing extension of the flexible hose. If the flexible hose is extendable it will preferably include a coil spring (in common with conventional extendable flexible hoses) and can be fitted with a rotatable joint to counter the unwinding of the spring as this is extended.

Preferably, the vacuum cleaner has a handle connected to the suction head. Preferably also, the length of flexible hose is connected to the handle. In a particularly desirable embodiment the length of flexible hose lies alongside a part of the handle. The flexible hose (and similarly the substantially rigid hose) can therefore be of significant length, permitting the inlet nozzle to be operated a significant distance away from the suction head. The inlet nozzle can for example be manipulated to reach the ceiling of a room with the suction head remaining upon the ground.

Desirably, the substantially rigid hose can be extendable, preferably telescopically extendable. This increases the range of movement available to the inlet nozzle whether or not the flexible hose is also extendable.

BRIEF DESCRIPTION OF THE PREFERRED EMBODIMENTS

The invention will now be described in more detail, by way of example, with reference to the accompanying drawings, in which:

FIG. 1 shows a side view of a vacuum cleaner according to the present invention, partially in section, with the inlet nozzle located within the receptacle; and FIG. 2 shows a view similar to that of FIG. 1 with the inlet nozzle removed from the receptacle.

DETAILED DESCRIPTION

The vacuum cleaner 10 of the present invention is shown in FIGS. 1 and 2. In common with known vacuum cleaners, the vacuum cleaner 10 has a suction head 12 connected to a handle (not shown). In use, a user grasps the handle and drives the suction head 12 along a desired path.

The connection of the handle to the suction head (not shown) may include a pivot and a swivel to allow steering of the suction head, in known fashion.

The suction head 12 has a brush chamber 14 in which is housed a rotatable brush 1, the brush 1 having a set of bristles (not shown) of known form which can project through an opening 16 at the leading end of the bottom of the suction head 12.

The opening 16 communicates with the dirt-collection chamber 2 by way of a primary air flow duct 18. Adjacent to the dirt-collection chamber 2 is a filter 4. The suction head 12 has suction means to create a flow of air into the suction head during use. In this embodiment the suction means is a motor 5 which drives an impeller (not shown). The impeller (which may alternatively be a fan or turbine) acts to draw air into the suction head 12 through the opening 16, along the primary air flow duct 18 and into the dirt-collection chamber 2. The air then passes through the filter 4, past the impeller and out of the suction head through one or more outlets (not shown). The dirt and debris which is removed from the floor surface by the rotating brush 1 and/or by the air flow cannot pass through the filter 4 and is retained within the dirt-collection chamber 2 for subsequent disposal.

The operation described above is common to prior art vacuum cleaners, including in particular that described in WO2012/085567.

The present vacuum cleaner 10 has a secondary air flow duct communicating with the dirt-collection chamber 2, the secondary air flow duct comprising an inlet nozzle 7, a length of substantially rigid hose 8 and a length of flexible hose 9. The secondary air flow duct is permanently connected to the dirt-collection chamber 2. As seen in the figures, the secondary air flow duct terminates at outlet 20 within the dirt-collection chamber 2, the outlet 20 being spaced from and separate from the primary air flow duct 18.

In the configuration of FIG. 1 the vacuum cleaner 10 is adapted for floor cleaning, i.e. little or no air flows along the secondary air flow duct and into the dirt-collection chamber, and instead substantially all of the air being driven by the impeller is drawn in through the opening 16. In this configuration the inlet nozzle 7 is located within a receptacle 6, the receptacle being a substantially air-tight fit around the inlet nozzle so that, despite the suction created by the motor 5 and impeller, substantially no air can enter the inlet nozzle 7 when located within the receptacle 6.

In the configuration of FIG. 2 on the other hand, the vacuum cleaner is adapted for above-floor cleaning, or for cleaning particular areas (perhaps by way of a tool fitted to the inlet nozzle 7). It will be seen that the receptacle 6 contains a detection means (in this embodiment in the form of a lever) 22 which is spring-biased to the position of FIG. 2. When the inlet nozzle 7 is removed from the receptacle 6 the detection means 22 automatically moves to the position of FIG. 2.

When the detection means 22 moves to the position of FIG. 2, it operates an actuation means (not shown) connected to a valve member 3, causing the valve member 3 to close the primary air flow duct 18. The valve member 3 can be latched into its closed position, or it can be retained in that position by the actuation means, it being appreciated that significant force will be required to maintain the valve member 3 closed if the inlet nozzle 7 should become blocked for example (it can if desired be arranged that the valve member 3 will open if the pressure within the dirt-collection chamber 2 drops to a predetermined level, in order to avoid potential damage to the motor 5).

There may be a purely mechanical connection between the detection means 22 and the actuation means, or there may be an electrical connection. In embodiments having an electrical connection the detection means 22 could be a switch and the actuation means could be a motor.

When the valve member 3 is closed, little or no air flows along the primary air duct 18 and substantially all of the air being driven by the impeller is drawn through the inlet nozzle 7 and along the secondary air duct 8,9.

It will be appreciated that the brush 1 is redundant when the vacuum cleaner 10 is being used for above-floor cleaning, and it can be arranged that the switch 22 also deactivates the motor driving the brush 1 to rotate. Thus, it is desirable that the brush 1 is not driven by the motor 5, but rather by a separate brush motor, so that the brush motor can be switched off whilst the motor 5 continues to operate and draw air along the secondary air duct 8,9.

It is arranged that the inlet nozzle 7 is sized to accommodate a crevice tool, an upholstery tool and a dust brush, so that a chosen one of these tools can be fitted to the inlet nozzle 7 for particular cleaning operations. The tools can be carried upon the vacuum cleaner 10 when not in use, in known fashion.

When it is desired to revert to floor cleaning, the inlet nozzle 7 is inserted into the receptacle 6, depressing the switch 22. Depression of the switch 22 causes the motor (not shown) to open the valve member 3, and also initiates the rotation of the brush 1. In less desirable embodiments the depression of the switch 22 does not actuate the valve member 3 to open, but instead simply releases the valve member 3 to be forced open by the air flow along the primary air duct 18 once the inlet nozzle 7 is fitted in its receptacle 6.

The air flow in each of the configurations of use is represented by the arrows in the two figures.

It will be understood that the handle of the vacuum cleaner 10 lies behind the flexible hose 9 in the orientation of FIGS. 1 and 2, so that the handle cannot be seen in these drawings. The flexible hose 9 is a little shorter than the handle and is mounted upon, and supported by, the handle along its length. Though not shown in FIG. 2, when it is desired to undertake above-floor cleaning the flexible hose 9 may be released from the handle and bent as desired so that the inlet nozzle 7 can be manipulated to the position of use.

In addition, the substantially rigid hose 8 includes a telescopic joint 24 to permit further adjustment and an increased range of movement.

Because the flexible hose 9 is as long as the handle, and the substantially rigid hose 8 is at least as long as the handle, the flexible hose 9 in this embodiment is not extendable. However, in other embodiments an extendable flexible hose could be provided so as to increase the range of movement of the inlet nozzle. The extendable flexible hose could include a rotatable joint to counter any tendency of the flexible hose to twist as it is extended.

It would alternatively be possible to use the rigid hose as the handle. All of the tools could be mounted on the handle to provide a very compact and convenient embodiment.

The invention claimed is:

1. A vacuum cleaner having a suction head adapted to be moved across a surface to be cleaned, the suction head having a leading end and a trailing end, the suction head having:

a rotatable brush, the rotatable brush being located in a brush chamber at the leading end of the suction head, the brush chamber having an opening through which a part of the rotatable brush projects, the opening and the rotatable brush spanning substantially the full width of the suction head;

suction means adapted to create a flow of air into the suction head during use;

a dirt-collection chamber;

a filter located downstream of the dirt-collection chamber;

a primary air flow duct connecting the brush chamber to the dirt-collection chamber and through which air can flow into the dirt collection chamber during use, a secondary air flow duct connected to the dirt-collection chamber and through which air can flow into the dirt collection chamber during use, the secondary air flow duct comprising a length of hose terminating in an inlet nozzle;

the suction head having a receptacle adapted to receive the inlet nozzle when not in use, the inlet nozzle being a substantially air-tight fit within the receptacle.

2. The vacuum cleaner according to claim 1 in which the primary air flow duct includes a valve member which can substantially close the primary air duct.

3. The vacuum cleaner according to claim 2 in which the valve member is adapted to close the primary air duct when the secondary air flow duct is in use.

4. The vacuum cleaner according to claim 2 in which the receptacle has a switch which can be actuated by the inlet nozzle.

5. The vacuum cleaner according to claim 4 in which the switch controls the position of the valve member.

6. The vacuum cleaner according to claim 1 in which the hose is a two-part hose, the first part being flexible and the second part being substantially rigid.

7. The vacuum cleaner according to claim 6 in which the first part of the hose is extendable.

8. The vacuum cleaner according to claim 7 in which the first part of the hose is connected to a rotatable joint.

9. The vacuum cleaner according to claim 1 having a handle connected to the suction head.

10. The vacuum cleaner according to claim 7 in which the first part of the hose is releasably connected to a handle.

11. The vacuum cleaner according to claim 10 in which the first part of the hose lies alongside a part of the handle.

12. The vacuum cleaner according to claim 6 in which the second part of the hose is extendable.

13. The vacuum cleaner according to claim 12 in which the second part of the hose is telescopically extendable.

* * * * *